United States Patent [19]

Koul

[11] 4,233,065

[45] Nov. 11, 1980

[54] EFFECTIVE BORON ALLOYING ADDITIVE FOR CONTINUOUS CASTING FINE GRAIN BORON STEELS

[75] Inventor: Maharaj K. Koul, Tonawanda, N.Y.

[73] Assignee: Foote Mineral Company, Exton, Pa.

[21] Appl. No.: 967,696

[22] Filed: Dec. 8, 1978

Related U.S. Application Data

[63] Continuation-in-part of Ser. No. 888,338, Mar. 20, 1978, abandoned.

[51] Int. Cl.[2] ..... C21C 7/00; B22D 27/18; B22D 21/02

[52] U.S. Cl. ..... 75/134 S; 75/53; 75/123 L; 75/129; 75/134 F

[58] Field of Search ..... 75/134 S, 134 F, 123 L, 75/129, 53, 58

[56] References Cited

U.S. PATENT DOCUMENTS

| | | | |
|---|---|---|---|
| 3,331,680 | 7/1967 | Leupold | 75/53 |
| 3,383,202 | 5/1968 | Lynch | 75/122 |
| 3,512,957 | 5/1970 | Brotzmann et al. | 75/49 |
| 3,540,518 | 11/1970 | Osterholtz | 164/82 |
| 3,623,862 | 11/1971 | Spengler et al. | 75/57 |
| 3,718,173 | 2/1973 | Snow | 164/82 |
| 3,822,735 | 7/1974 | Miltenberger et al. | 164/56 |
| 3,841,861 | 10/1974 | Miltenberger | 75/53 |
| 3,922,166 | 11/1975 | Koros et al. | 75/58 |
| 3,935,895 | 2/1976 | Fastner et al. | 164/56 |
| 4,015,655 | 4/1977 | Fastner et al. | 164/66 |

FOREIGN PATENT DOCUMENTS

| | | |
|---|---|---|
| 491721 | 11/1975 | U.S.S.R. . |
| 497350 | 12/1975 | U.S.S.R. . |
| 498349 | 1/1976 | U.S.S.R. . |

OTHER PUBLICATIONS

Foote Notes on Steel, No. 1, 1974, Published by Foote Mineral Co., Exton, Pa.

Foote Notes on Steel, No. 2 and 3.

". . . Deoxidation . . . Castability . . . Steel", Met. Soc. IRSID Conf. on Continuous Casting, Biarritz, May 1976.

*Primary Examiner*—L. Dewayne Rutledge

*Assistant Examiner*—Upendra Roy

*Attorney, Agent, or Firm*—Howson and Howson

[57] ABSTRACT

An effective alloying additive for adding small (5–30 ppm) quantities of boron to steel which is continuously cast, said additive containing 0.5–1.5% boron, 8–15% calcium, 8.5–20% titanium, 40–60% silicon, up to 1.5% of aluminum, and balance iron.

The additive makes possible continuous casting of boron steel without the tundish nozzle-clogging problem associated with aluminum-killed steel, and the cast steel contains sufficient soluble boron to provide a good hardenability effect.

3 Claims, No Drawings

EFFECTIVE BORON ALLOYING ADDITIVE FOR CONTINUOUS CASTING FINE GRAIN BORON STEELS

This application is a continuation-in-part of application Ser. No. 888,338 filed Mar. 20, 1978, now abondoned.

BACKGROUND OF THE INVENTION

It is being stated with greater frequency that this country is an island as regards the need for importation of various raw materials essential to the health and growth of the nation's industry. Typical of such raw materials are various elements such as chromium, manganese, nickel, vanadium, molybdenum, tungsten and columbium used in the steel industry, the major portion of which are derived from foreign sources. The constant political turmoil in many countries where there are significant or major sources of such elements makes the availability of such elements unpredictable. In addition, many of these elements are scarce and frequently difficult to obtain in desired quantities. It's generally forecast that the situation may continue for some time.

There is available in this country one element which is available in almost limitless supply and which can be effectively used to replace, at least in part, such critical elements as chromium, manganese, nickel, molybdenum, vanadium, tungsten, columbium and the like. That element is boron, and it must be used more extensively to develop and produce boron steels which would replace alloy steels in certain critical applications.

Boron steels are not new. The original concept of using small amounts of boron to increase the hardenability of steel was conceived in the mid-twenties, with the first commercial applications coming in the mid-thirties.

Conventionally, boron steels have been made by ingot casting aluminum-killed steels containing very small amounts of boron, e.g. at least about 0.0030% B for low carbon (about 0.1% C) steels and at least about 0.0005% for high carbon (0.6% C) steels. The boron hardenability effect is only achieved when boron is in the so-called soluble or free uncombined state, i.e. not combined with oxygen, nitrogen or carbon in the steel. However, boron has a great affinity for oxygen and nitrogen, and these gases in the steel must either be removed or controlled if the cast steel is to contain the necessary amount of soluble boron to provide its full hardenability effect.

In order to enable the boron to be present in the steel in an uncombined state, elements such as aluminum, titanium and zirconium, which have a greater affinity for oxygen and nitrogen than boron, have been included in boron alloying additives to protect the boron from such gases. Aluminum, in addition to providing proper deoxidation of steel and protecting boron from oxygen in steel, provides a fine grained steel. However, there are a number of problems associated with aluminum-killed steels.

Alumina inclusions remaining in steel deoxidized with aluminum are detrimental to the physical properties of steel. In addition, high alumina residuals in steel as a result of aluminum deoxidation practice provide undesirable surface characteristics in that the surface is very rough in both ingot and continuously cast steel and needs conditioning for removing the roughness. When such steel is rolled, surface defects are present in the rolled product by reason of these surface and subsurface inclusions.

In continuous casting of aluminum-killed steels, the alumina formed during deoxidation deposits in the nozzle of the tundish, clogging the nozzle. The flow of molten steel is thereby restricted with evantual blockage. The nozzle clogging problem is associated with the total aluminum content of the steel, and the level of aluminum at which nozzle blockage occurs depends upon the size of the nozzle, the smaller the diameter of the nozzle, the lower the aluminum content which will cause blockage. For example, aluminum levels greater than about 0.007% can cause blockage of one inch diameter nozzles. Thus, it is difficult to cast aluminum-killed steels in a continuous caster and more particularly in a multiple strand billet caster having metering nozzles of less than one inch diameter.

SUMMARY OF THE INVENTION

This invention pertains to a novel boron alloying additive for producing boron steel by the continuous casting method. The additive effectively deoxidizes the steel while at the same time making effective additions of soluble boron to the steel. Depending upon the amount of additive used, no prior deoxidation of the steel, as for example by aluminum addition which results in harmful alumina inclusions, is required. However, in some instances it may be desirable to at least partially kill the steel with silicon and manganese.

The boron alloying additive of the present invention, in addition to containing small quantities of boron, also contains calcium and titanium in an iron-silicon base alloy in amounts sufficient to protect the boron from oxygen. In addition, the quantity of titanium is such as to protect the boron from nitrogen. With the alloying additive of this invention, a boron steel containing sufficient boron to provide the steel with good hardenability effect can be obtained. The steel can be continuously cast without tundish nozzle clogging, and by reason of the absence of alumina inclusions, steel billets having desirable surface characteristics are produced.

It is an object of this invention to provide a novel boron alloying additive for producing fine grain boron steel by the continuous casting method.

Other objects and advantages of the invention will be apparent from the following detailed description of the invention and appended claims.

DETAILED DESCRIPTION OF THE INVENTION

The novel boron alloying additive has the following composition:

TABLE I

| Elementa | Weight Percent |
|---|---|
| Boron | 0.5 to 1.5 |
| Calcium | 8 to 15 |
| Titanium | 8.5 to 20 |
| Aluminum | 0 to 1.5 |
| Silicon | 40 to 60 |
| Iron | balance |

Preferred additives which, by reason of their low aluminum and optimum boron, calcium and titanium content are particularly suitable for use in producing fine gain boron steel by the continuous casting process, have the following composition:

TABLE II

| Elements | Weight Percent |
|---|---|
| Boron | 0.75 to 1.0 |
| Calcium | 10 to 11 |
| Titanium | 12 to 16 |
| Aluminum | up to 1.0 |
| Silicon | 45 to 55 |
| Iron | balance |

Preferably the aluminum content of the additive is as low as possible so as to avoid the formation of alumina inclusions, thus eliminating tundish nozzle clogging.

The alloying additives of this invention may be prepared by first forming a ferrosilicon alloy containing calcium and titanium to which may be added ferroboron or with which borax ($B_2O_3$) may be reacted in the presence of calcium metal to obtain the desired alloying additive.

The ferrosilicon alloy may be obtained by carbon reduction of a mixture of silica pebble, coarse limestone and lumpy ilmenite ore, which reaction may be carried out in a stationary, carbon-lined, submerged arc furnace. Iron scrap may be added to the mix to provide the alloy with the desired iron content. The basic reactions between carbon and $SiO_2$, CaO, and $TiO_2$ to form the corresponding elements, Si, Ca and Ti with production of carbon monoxide, take place at temperatures above about 3000° F. (1650° C.).

The resulting ferrosilicon alloy has the composition given in Table III, below, and is used in the iron foundry as an inoculant and to reduce chill by promoting graphite flake formation in thin section (e.g. up to 1" in thickness) castings. It is also an effective deoxidizer in steel castings where it minimizes porosity and improves the mechanical properties of the casting.

TABLE III

| Elements | Weight Percent |
|---|---|
| Calcium | 5–7 |
| Titanium | 9–11 |
| Silicon | 50–55 |
| Iron | Balance |

The molten ferrosilicon alloy of the above composition may then be poured from a ladle into a second preheated ladle containing anhydrous borax ($B_2O_3$) and calcium in the form of metal crowns. The added calcium is required to replace that consumed in $B_2O_3$ reduction:

$$B_2O_3 + 3Ca \rightarrow 2B + 3CaO$$

The boron alloying additive can also be obtained by additions of ferroboron to the molten ferrosilicon alloy.

The amount of additive used will depend upon the boron content thereof and the carbon content of the steel to which it is added. Generally, the desired level of soluble boron in the steel can be obtained by using from about 6 to about 10 pounds, preferably about 8 pounds, of additive, per ton of steel being cast. Of course, larger quantities in the above range should be used for low carbon steels which require on the order of at least about 0.0030% soluble boron, as compared to 0.0005% for high carbon steels.

The following illustrative, but not limiting examples of this invention as it has been actually carried out will further inform those skilled in the art of the nature and special utility of the invention.

EXAMPLE 1

6500 pounds of boron additive were produced, using the conventional electric arc smelting technique, by carbon reduction of silica pebble, coarse limestone and ilmenite ore in a stationary carbon-lined submerged arc furnace. Final chemical adjustments were made by addition of calcium metal crowns, titanium scrap and anhydrous borax in the ladle to obtain an additive having the composition given in Table IV, below:

TABLE IV

| Elements | Weight Percent |
|---|---|
| Boron | 0.81 |
| Calcium | 11.61 |
| Titanium | 8.66 |
| Aluminum | 0.95 |
| Silicon | 46.99 |
| Iron | Balance |

EXAMPLE 2

A large scale plant trial, involving a 20 ton heat of electric furnace low carbon (0.18% C) steel, which had been partially killed with silicon and manganese, was carried out using the boron alloying additive of Example 1. 6-¼ pounds of the additive and ½ pound of titanium metal (90% Ti) per ton of steel were added at the ladle. By reason of the addition of some titanium as metal, the titanium content of the master alloy effectively was increased to 14.7 percent. The steel was introduced to a tundish from which it was continuously cast through 0.532 inch diameter nozzles to form 4½×6½ inch billets. No nozzle clogging problem was encountered in casting the heat. Samples of the boron steel so produced were analyzed for boron using the procedure of ASTM Spec. E30-76, and the results are set forth in Table V, below:

EXAMPLE 3

1000 pounds (7.7 /ton) of the additive of Example 1 were added at the ladle to 130 tons of 10B50 high carbon (0.54% C) steel, which had been partially killed with silicon and manganese, and the steel was stirred for 4 minutes under an atmosphere of nitrogen. The steel was introduced to a tundish from which it was continuously cast through ⅝ inch diameter nozzles to form 4 inch ×4 inch billets. No nozzle clogging problem was encountered in casting the heat and the cast billets had good surface characteristics. The boron steel was analyzed for boron by the procedure of ASTM Spec. E30-76, and the results are given in Table V, below:

EXAMPLE 4

The procedure of Example 3 was repeated and a boron steel having a boron content as set forth in Table V below was obtained.

TABLE V

| Example | Soluble Boron % | Insobuble Boron % | Total Boron % |
|---|---|---|---|
| 2 | 0.0028 | 0.00038 | 0.00318 |
| 3 | 0.0024 | 0.0003 | 0.0027 |
| 4 | 0.0024 | 0.00019 | 0.00259 |

The amounts of soluble boron recited in Table V will, depending upon other metallurgical considerations, such as heat treatment and grain size provide the steel with good hardenability effect.

What is claimed is:

1. A boron alloying additive for continuous casting of boron steel consisting essentially of from about 0.5 to about 1.5 percent boron, from about 8 to about 15 percent calcium, from about 8.5 to about 20 percent titanium, up to about 1.5 percent of aluminum, from about 40 to about 60 percent silicon and balance iron, said percentages being by weight, based on the total weight of said alloy.

2. An additive according to claim 1 consisting essentially of from about 0.75 to about 1 percent boron, from about 10 to about 11 percent calcium, from about 12 to about 16 percent titanium, up to about 1.0 percent aluminum, from about 45 to about 55 percent silicon and balance iron.

3. An additive according to claim 1 consisting essentially of about 0.8 percent boron, about 12 percent calcium, about 14.5 percent titanium, about 0.5 percent aluminum, about 47 percent silicon, balance iron.

* * * * *

UNITED STATES PATENT AND TRADEMARK OFFICE

CERTIFICATE OF CORRECTION

PATENT NO. : 4,233,065

DATED : November 11, 1980

INVENTOR(S) : Maharaj Kishen Koul and Samir Kumar Banerji

It is certified that error appears in the above-identified patent and that said Letters Patent are hereby corrected as shown below:

Column 1 of the Title Page, item [75] should read --Inventors: Maharaj K. Koul, Tonawanda, New York, and Samir K. Banerji, Norristown, Pennsylvania.--;

Column 2, line 56, TABLE I, the heading "Elementa" should read --Elements--;

Column 4, line 39, "(7.7/ton)" should read --(7.7 #/ton)--.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*